US008959906B2

(12) United States Patent
Haines et al.

(10) Patent No.: US 8,959,906 B2
(45) Date of Patent: Feb. 24, 2015

(54) GAS BOOSTERS

(75) Inventors: Robert B. Haines, Phoenix, AZ (US); Richard Rosenthal, Mesa, AZ (US)

(73) Assignee: Fluke Corporation, Everett, WA (US)

( * ) Notice: Subject to any disclaimer, the term of this patent is extended or adjusted under 35 U.S.C. 154(b) by 917 days.

(21) Appl. No.: 13/135,329

(22) Filed: Jun. 22, 2011

(65) Prior Publication Data

US 2012/0325080 A1 Dec. 27, 2012

(51) Int. Cl.

| | |
|---|---|
| ***F01B 1/06*** | (2006.01) |
| ***F16D 31/02*** | (2006.01) |
| ***F04B 27/047*** | (2006.01) |
| ***F04B 27/067*** | (2006.01) |
| ***F04B 35/01*** | (2006.01) |
| ***F04B 39/10*** | (2006.01) |
| ***F04B 49/06*** | (2006.01) |
| ***F04B 49/08*** | (2006.01) |

(52) U.S. Cl.

CPC ..... *F04B 27/047* (2013.01); *F04B 27/067* (2013.01); *F04B 35/01* (2013.01); *F04B 39/102* (2013.01); *F04B 39/1073* (2013.01); *F04B 49/065* (2013.01); *F04B 49/08* (2013.01); *F04B 2205/05* (2013.01)

USPC ..... 60/498; 91/485; 91/491; 92/58; 60/418

(58) Field of Classification Search

USPC ..... 91/485, 491, 494, 498; 92/58, 72, 148; 60/413, 415, 418

See application file for complete search history.

(56) References Cited

U.S. PATENT DOCUMENTS

| | | | | |
|---|---|---|---|---|
| 2,217,796 | A * | 10/1940 | Dell | 92/58 |
| 2,461,121 | A | 2/1949 | Markham | |
| 4,105,371 | A | 8/1978 | Savage | |
| 6,805,122 | B2 | 10/2004 | Richey, II | |
| 7,488,159 | B2 | 2/2009 | Bhatt | |
| 2009/0178399 | A1 * | 7/2009 | Bishop | 60/413 |
| 2011/0103937 | A1 | 5/2011 | Ribas Junior | |

FOREIGN PATENT DOCUMENTS

| | | |
|---|---|---|
| GB | 213 541 | 10/1924 |
| GB | 890 060 | 2/1962 |
| WO | 01/50033 A1 | 7/2001 |

OTHER PUBLICATIONS

Extended European Search Report mailed Oct. 5, 2012, in European Application No. EP 12172755.6, filed Jun. 20, 2012, 7 pages.

Chinese Office Action dated Jul. 25, 2014, in Chinese Patent Application No. 201210209173.5, filed Jun. 20, 2012, 7 pages.

* cited by examiner

*Primary Examiner* — Michael Leslie

(74) *Attorney, Agent, or Firm* — Christensen O'Connor Johnson Kindness PLLC

(57) ABSTRACT

One or more examples of the gas boosters described herein aim to provide a light weight gas booster configured to produce high output pressure levels at high volumes. Generally described, one or more examples of the gas boosters reduce the dead volume in a piston assembly, thereby increasing the ratio of the output pressure to the input pressure. In that regard, several examples of the gas boosters disclosed herein have a first check valve as a disk-type check valve or the like and a second check valve as a ball-type check valve or the like. Furthermore, one or more examples include an inwardly acting cam configured to convert rotary motion to reciprocating motion by an inner surface thereof.

20 Claims, 7 Drawing Sheets

GAS BOOSTERS

BACKGROUND

Gas boosters are configured to boost a lower pressure gas, such as air or nitrogen, in a supply cylinder to a higher pressure. In many cases, gas boosters may receive the lower pressurized gas from the supply cylinder and upon pressurizing the gas, provide the higher pressurized gas to an accumulator for storage. One application for a gas booster is as a supply source for either a pressure controller or a calibrator. In some cases, pressure controllers and calibrators may be employed in remote locations, thus, requiring the gas booster to be portable. Some applications require the gas booster to be able to pressurize gas to high pressure levels, such as up to 10,000 pounds per square inch (psi). To achieve these pressure levels, the components of the gas booster tend to be excessively heavy or cause the gas booster to produce low volumes of high pressure gas.

Gas boosters can be powered by various means, each having its own limitations with regard to producing high pressure levels at high volumes while maintaining light weight. Pneumatically powered boosters may use gas from the supply cylinder to power the gas booster. This limits the volume of high pressurized gas that can be produced, because some of the supply gas is expended to power the gas booster itself. Hydraulically powered boosters use hydraulic pumps to generate the drive pressure, which are generally excessively heavy, resulting in the booster weighing over 45 pounds. Electrically powered boosters are generally heavy due, in part, to the piston assembly and the size of the electric motor required to actuate the piston assembly. There is, therefore, a need for light-weight, compact gas boosters that are configured to produce high pressures, preferably at high volumes.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In accordance with aspects of the present disclosure, an exemplary gas booster is provided. The gas booster may include at least one cylinder having a bore therein. The gas booster may include a piston that is moveable in the bore of the at least one cylinder thereby forming a cavity that expands and contracts in response to the piston moving within the bore. The cavity may be configured to receive a gas at a first pressure level via a first port and to output the gas at a second pressure level via a second port. The gas booster may further include a mechanism configured to cause the piston to move within the bore from a first position to a second position. The gas booster may further include a first check valve located proximate the first port and a second check valve located proximate the second port. The first check valve may selectively permit the gas to enter the cavity through the first port, and the second check valve may selectively permit the gas to exit the cavity though the second port. In some embodiments, the first and second check valves are configured and arranged so as to minimize the dead volume of the cavity when the piston has attained the second position.

In accordance with aspects of the present disclosure, another example of a gas booster is provided. The gas booster may include two or more cylinders having a bore therein. The gas booster may further include a piston moveable in each bore of the two or more cylinders, forming cavities with variable volume that expands and contracts in response to the pistons moving within the bores. The gas booster may include an inlet configured to receive a gas at a first pressure level and an outlet configured to output a gas at a second pressure level. The inlet may be selectively connected in fluid communication with the cavity via a first check valve and the outlet may be selectively connected in fluid communication with the cavity via a second check valve. The gas booster may further include a cam having an aperture forming an inner cam surface that surrounds the two or more cylinders and the pistons. The rotation of the cam may cause the inner cam surface to move the pistons from a first position to a second position.

In accordance with aspects of the present disclosure, a system is provided. The system may include one or more cylinders having a bore therein. The system may further include a piston moveable in each bore of the one ore more cylinders, forming a variable volume cavity that expands and contracts in response to the piston moving within the bore. The variable volume cavity may be configured to receive a gas at a first pressure level via a first port and to output the gas at a second, higher pressure level via a second port. The system may further include a cam including an aperture forming an inner cam surface that surrounds the one or more cylinders and the piston. The rotation of the cam may cause the inner cam surface to move the piston from a first position to a second position. The system may further include a first check valve located proximate the first port and a second check valve located proximate the second port. The first check valve selectively permits the gas to enter the cavity through the first port and the second check valve selectively permits the gas to exit the cavity through the second port. The system further includes a prime mover configured to rotate the cam and a control logic device. The control logic device may be configured to generate control signals and to provide the control signals to the prime mover. The control signals are configured to cause the prime mover to rotate the cam.

DESCRIPTION OF THE DRAWINGS

The foregoing aspects and many of the attendant advantages of this disclosure will become more readily appreciated as the same become better understood by reference to the following detailed description, when taken in conjunction with the accompanying drawings, wherein.

DETAILED DESCRIPTION

The following discussion provides examples of gas boosters powered by a prime mover in the form of a motor, such as an electric motor. One or more examples of the gas boosters described herein aim to provide a light weight gas booster configured to produce high output pressure levels, such as up to 10,000 psi, at volumes, such as, for example, between 25 and 100 cubic centimeters. As will be explained in more detail below, one or more examples of the gas boosters reduce the dead volume in the piston assembly, thereby increasing the efficiency of the gas booster, and allowing for lighter parts and/or a smaller sized motor. In that regard, several examples of the gas boosters disclosed herein may include a unique valve arrangement for reducing the dead volume in the piston assembly. Additionally, one or more examples aim to better distribute the torque generated by the motor. In that regard, one or more examples of the gas boosters may include a cam/cam follower arrangement configured to convert rotary motion of the motor (e.g. an electric motor etc.) to reciprocating motion of the pistons of the piston assembly in a more distributed manner. Furthermore, one or more examples aim to minimize the torque required to impart reciprocating movement to the gas booster's piston assembly. In that regard, the gas boosters may include a torque multiplier so that the gas boosters may use the smallest and lightest motor possible given the output requirements of the gas booster.

It should be appreciated that the examples of the gas boosters described herein may be applied to any system in which high pressure levels are desired, including but not limited to, pressure controllers, calibrators, fluid flow control systems, etc. Furthermore, it should be appreciated that the gas boosters described herein may be applied to any type of fluid, such as gas, gas-liquid combinations, or the like.

While illustrative embodiments are illustrated and described below, it will be appreciated that various changes can be made therein without departing from the spirit and scope of the invention. In that regard, the detailed description set forth below, in connection with the appended drawings where like numerals reference like elements, is intended only as a description of various embodiments of the disclosed subject matter and is not intended to represent the only embodiments. The embodiments described are provided merely as examples or illustrations and should not be construed as preferred or advantageous over other embodiments. The illustrative examples provided herein are not intended to be exhaustive or to limit the disclosure to the precise forms disclosed.

Figure 1:
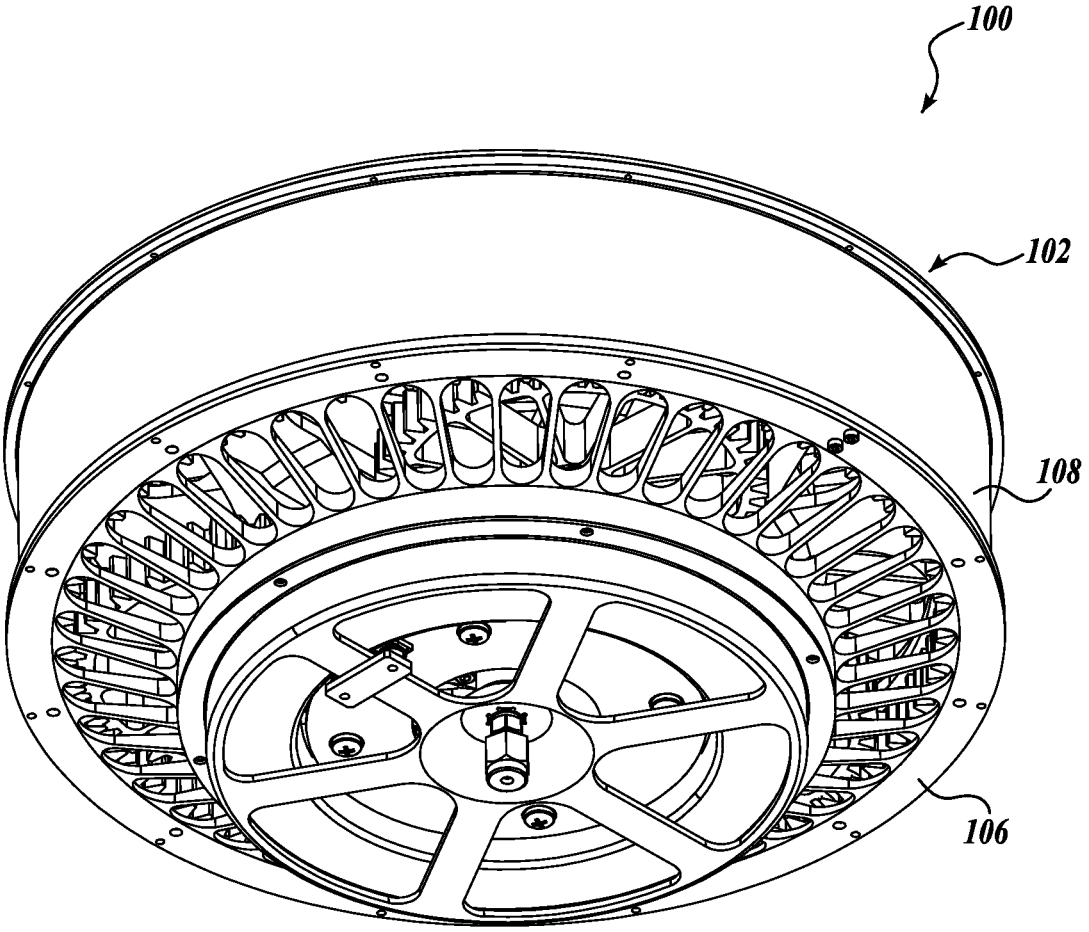
FIG. 1 is a bottom isometric view of a gas booster in accordance with aspects of the present disclosure.
Figure 2:
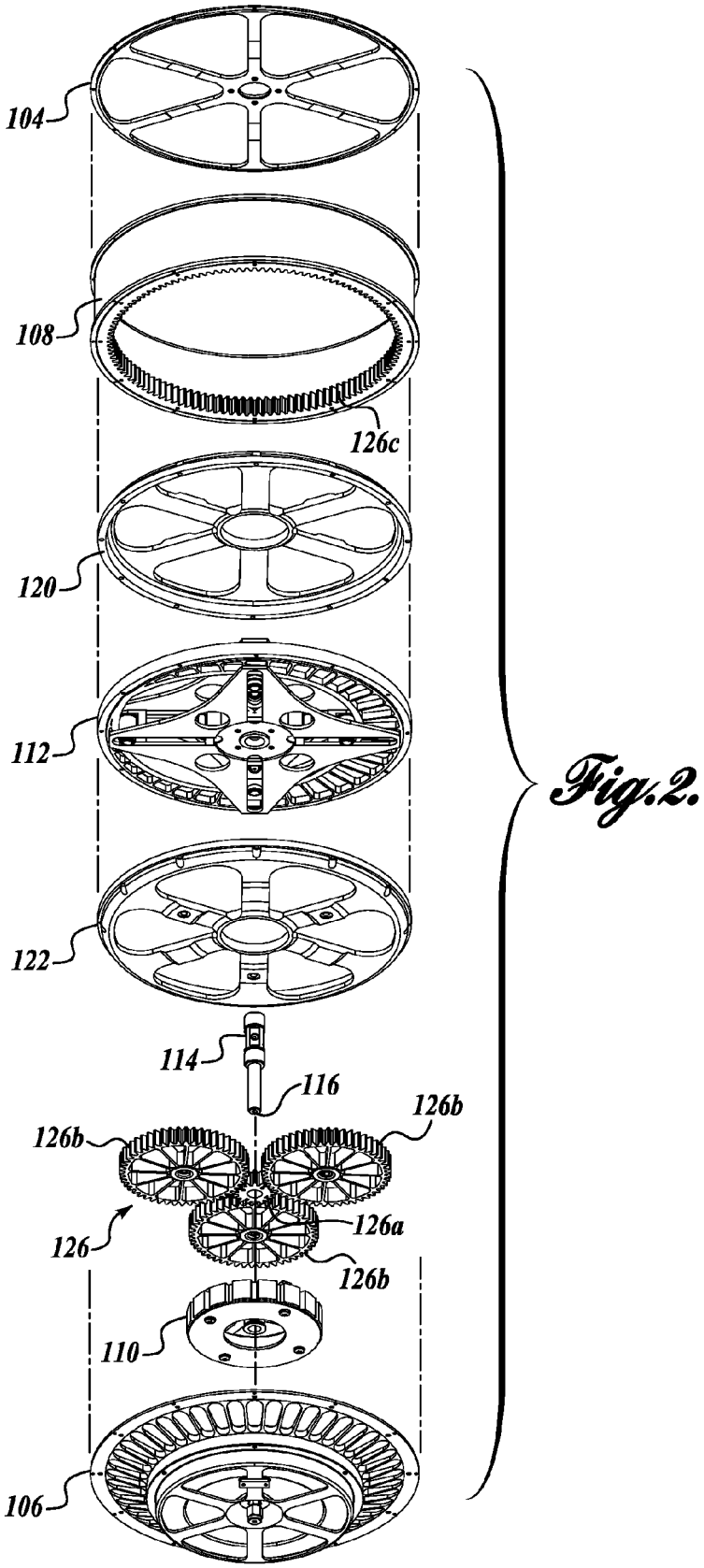
FIG. 2 is an exploded view of the gas booster of FIG. 1.

Turning now to FIGS. 1 and 2, there is shown one embodiment of a gas booster 100 in accordance with aspects of the present disclosure. As can be seen in FIGS. 1 and 2, the gas booster 100 includes a housing 102 having a top lid 104 and a bottom lid 106 each removably secured to opposite sides of a hollow surround 108. As is best shown in FIG. 2, located within the housing 102 is a motor 110, such as a frameless electric motor, operatively connected to a pump assembly 112. It is to be appreciated that only the rotor of the motor 110 is shown. In the illustrated embodiment, the motor 110 and the pump assembly 112 are mounted about a stationary main shaft 114.

The gas booster 100 further includes an inlet 116 (see FIG. 4) for receiving a fluid at a first pressure and an outlet 118 (see also FIG. 4) for discharging the fluid at a second, higher pressure. The inlet 116 may be connected in fluid communication with a supply bottle (not shown) comprising a fluid, such as a gas, pressurized at a lower pressure level, such as pressure levels between approximately 500 psi, to approximately 3000 psi, among others. In some embodiments, the inlet 116 is in fluid communication with atmospheric air. The outlet 118 may be connected in direct or selective fluid communication with a device, such as an accumulator (not shown), that receives and stores the high pressure gas, such as up to 10,000 psi or more, generated by the gas booster 100. In operation, the motor 110 is configured to cause the pump assembly 112 to pump the fluid received from the inlet 116 at the first pressure to the second, higher pressure and to provide the second, higher pressure to the outlet 118. The second, higher pressure may then be provided to the accumulator as will be further discussed below.

In one embodiment, as best shown in FIG. 2, an upper support member 120 and a lower support member 122 may also be located within the housing 102 and mounted about the main shaft 114, if desired. In some embodiments, the upper and/or lower support members 120 and 122 may be secured to the pump assembly 112 by mechanical fasteners, locking parts, or other means.

Still referring to the embodiment of FIGS. 1 and 2, an output shaft (not shown) of the motor 110 is operatively connected to the lower support member 120 and is configured to rotate the lower support member 122 in a clockwise or counter-clockwise direction about the main shaft 114. Rotation of the lower support member 120, in turn, causes the upper support member 122 and portions of the pump assembly 112 to rotate about the stationary main shaft 114, as will be described in more detail below.

In the illustrated embodiment, the motor 110 is operatively connected to the lower support member 120 via a mechanical advantage device 126. The mechanical advantage device 126 is configured to amplify the amount of torque generated by the motor 110 and/or to decrease the rotational speed provided to the lower support member 122. This may allow the gas booster 100 to employ a smaller (i.e. lower power) and lighter motor 110. In the illustrated embodiment, the mechanical advantage device 126 is a planetary gear set, which includes a sun gear **126*a*, multiple planetary gears 126*b*, and a ring gear 126*c*, which in the embodiment shown is formed on an inner surface of the stationary surround 108 of the housing 102. In this embodiment, the output shaft of the motor 110 is drivingly connected to the sun gear 126*a* so as to cause the sun gear 126*a* to rotate. Each of the planetary gears 126*b* are connected to the lower support member 122, such as by a shaft and bearing coaxially located at each of the planetary gear's center of rotation. The movement, i.e., orbiting, of the planetary gears 126*b* causes the lower and/or upper support members 120 and 122 to rotate at a lower speed than the output shaft of the motor. It is to be understood that the mechanical advantage device 126** is optional.

Figure 3:
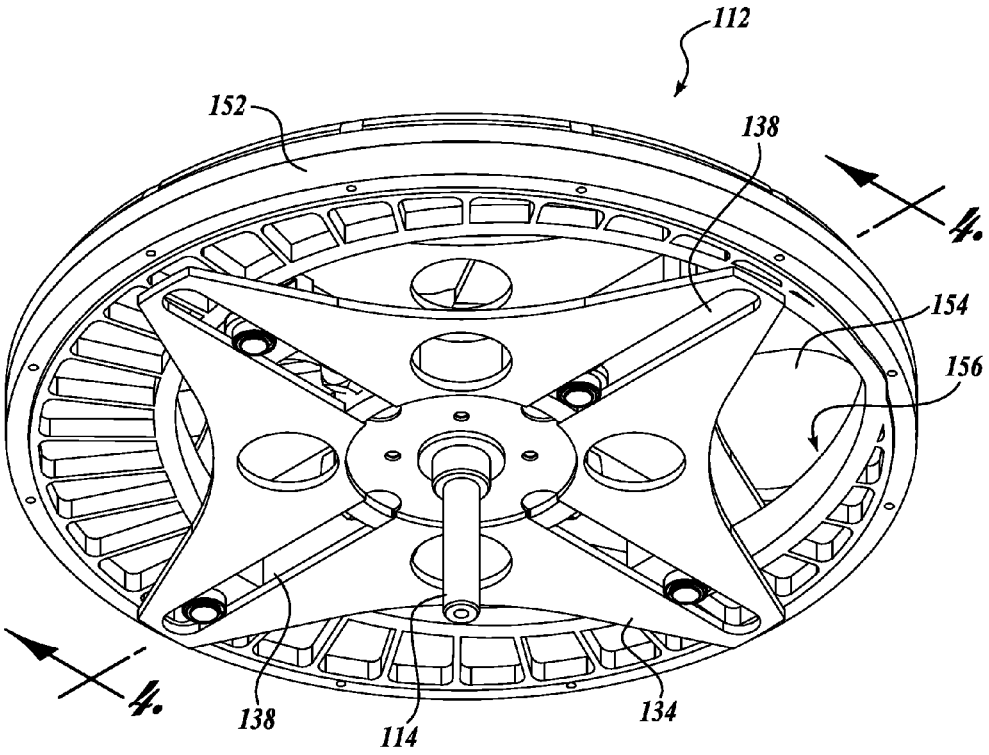
FIG. 3 is a bottom isometric view of the pump assembly in accordance with aspects of the present disclosure.
Figure 4:
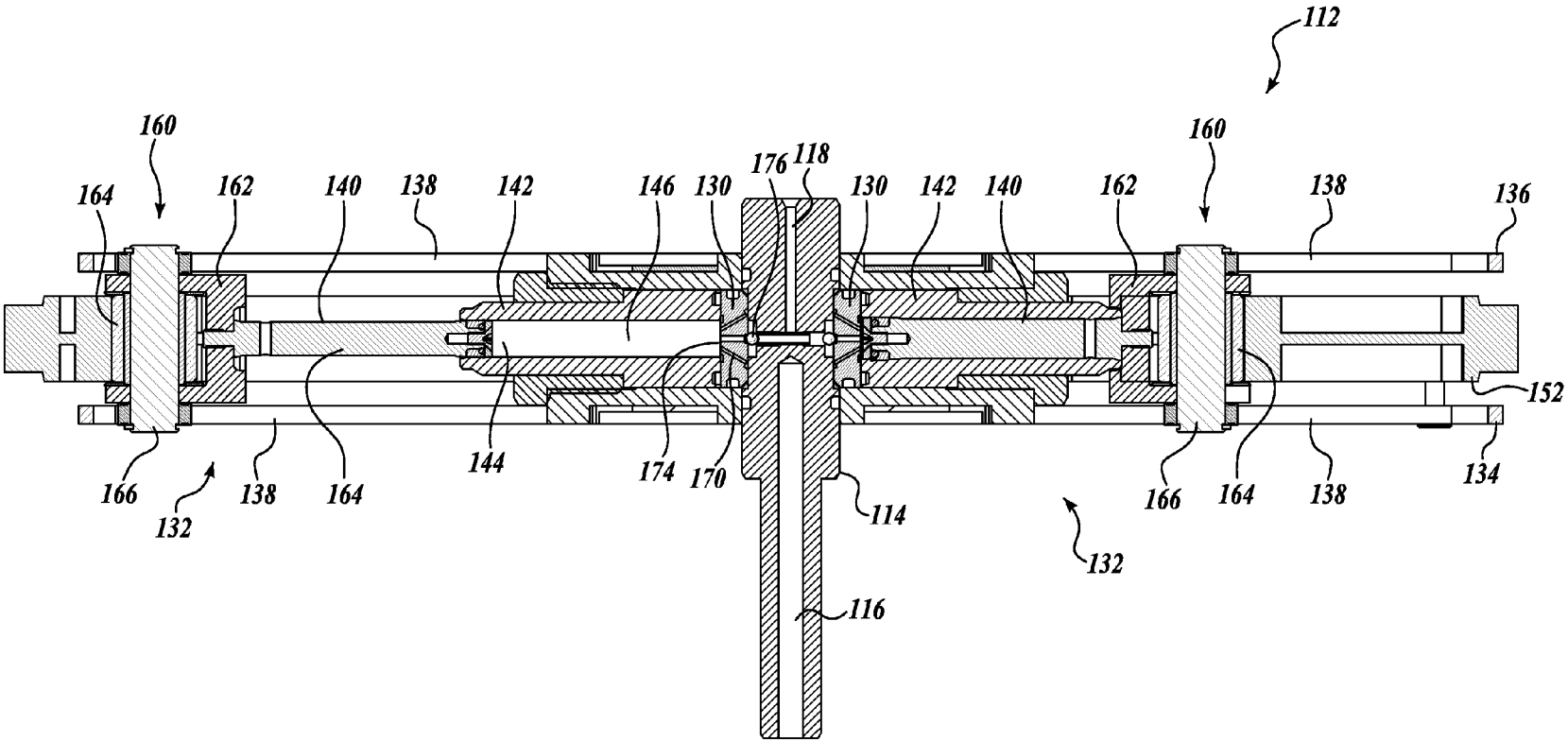
FIG. 4 is a cross-sectional view of the pump assembly of FIG. 3.
Figure 5:
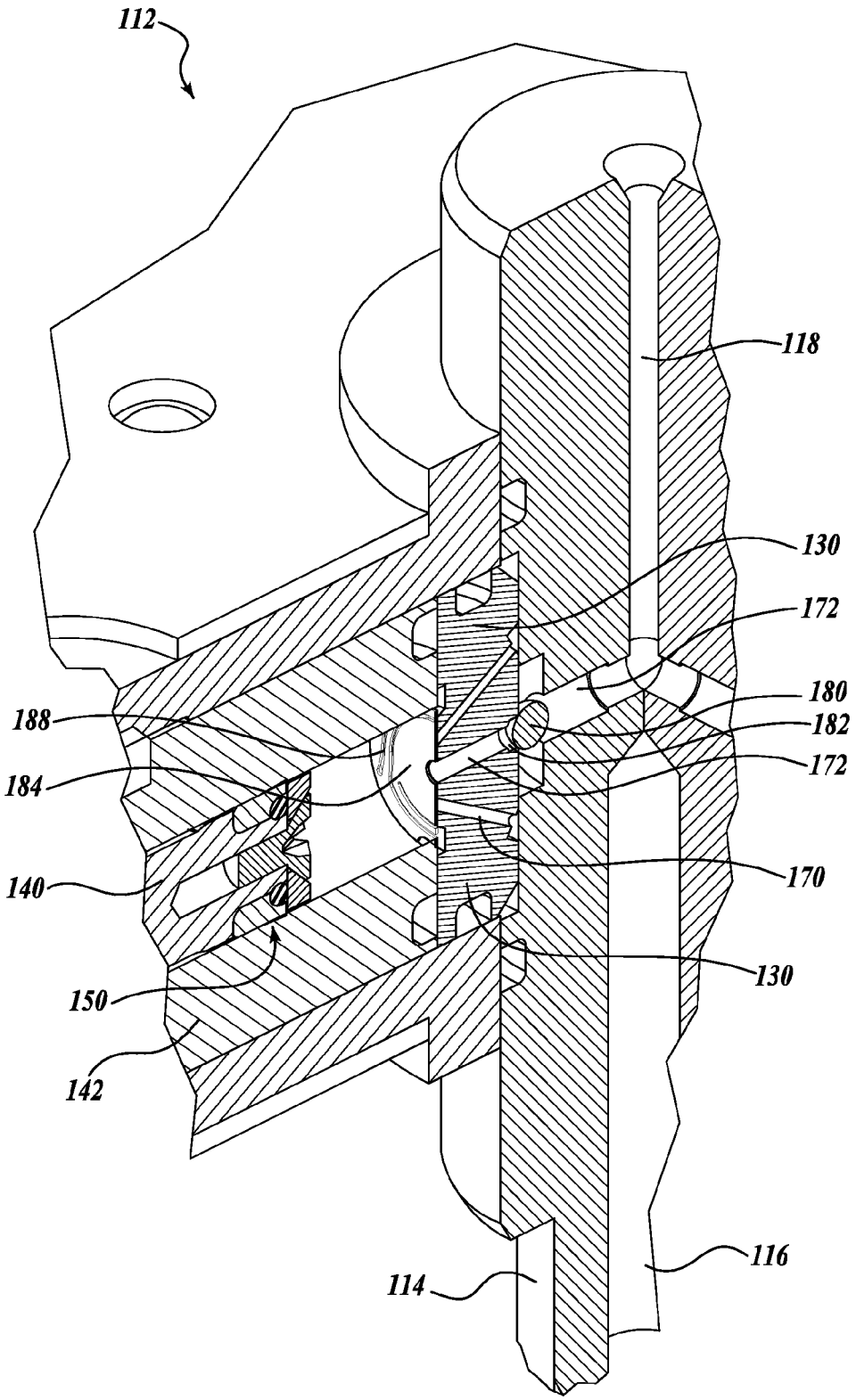
FIG. 5 is a partially close-up view of the pump assembly of FIG. 4.

Turning now to FIGS. 3-5, there is shown a bottom isometric view, a cross-sectional view, and a partial, close-up cross-sectional view of the pump assembly 112 of FIG. 2. The pump assembly 112 includes a valve manifold 130 fixedly mounted to the main shaft 114 and a number of pumps 132 radially disposed about the main shaft 114. In some embodiments, the pump assembly 112 also may include a lower guide plate 134 and/or an upper guide plate 136 that are secured to a stationary feature of the gas booster 100, such as the valve manifold 130, as is best shown by FIGS. 4 and 5. In that regard, the lower and upper guide plates 134 and 136 remain stationary about the main shaft 114. Each of the lower and upper guide plates 134 and 136 may include one or more elongated openings 138, which are configured to remove radial forces imparted on a piston of a corresponding pump such that the piston is axially driven, as will be explained in more detail below.

Still referring to FIGS. 4 and 5, each pump 132 includes a piston 140 and a cylinder 142 having a cylindrical bore 144 therethrough. The pistons 140 are configured to be reciprocatingly driven in the bores 144 of their respective cylinders 142, in a manner that will be explained in more detail below. The bore 144 of each cylinder 142, in combination with each piston 140 and the valve manifold 130, defines a chamber 146 with a variable volume disposed on a first side of the piston 140. It is to be appreciated that each chamber 146 may be sealed from atmosphere by piston seals 150. Although four pumps 132 disposed uniformly around the main shaft are shown in the illustrated embodiment, it is to be appreciated that any number of pumps may be used, including a single pump.

As described briefly above, each piston 140 reciprocates within the bore 144 of its respective cylinder 142. To impart the reciprocating movement to the pistons 140, the pump assembly 112 further includes a rotary-to-reciprocating mechanism 152 as best shown in FIGS. 3 and 4. In some embodiments, the rotary-to-reciprocating mechanism 152 may be secured to the output shaft of the motor 110, the mechanical advantage device 126, and/or the lower support member 122 (FIG. 2). Each piston 140 may act against a biasing force that pushes the piston 140 away from the main shaft 114. Such a biasing force may be generated in some embodiments by the supply pressure or a spring (not shown).

It is to be appreciated that the rotary-to-reciprocating mechanism 152 may be any type of mechanism configured to convert rotary motion into reciprocating motion, such as a cam, a crank and arm assembly, and the like. In the illustrated embodiment, the rotary-to-reciprocating mechanism is an inwardly acting cam 152 configured to rotate about the main shaft 114. That is, the cam 152 includes an aperture 154 forming an inner cam surface 156 that is configured to impart reciprocating movement to the pistons 140. It is to be appreciated that more than one cam 152 may be provided. In operation, as the motor 110 (FIG. 2) imparts rotational movement on the cam 152, the inner cam surface 156 causes each piston 140 to move towards the main shaft 114 compressing the volume of its chamber 146. During continued rotation of the cam 152, the biasing force allows the piston 140 to move away from the main shaft 114, expanding the volume of its chamber 146.

In the illustrated embodiment, the inner shape of the cam 152 is derived based on uniform torque requirements. This results in limiting the maximum torque required to impart the reciprocating movement to the pistons against the compression forces of the compressed fluid. In that regard, the components, such as pistons, motors, cams, etc., of the gas booster 100 may be lighter and/or smaller by virtue of the lower maximum torque required. Moreover, it is to be appreciated that the shape of the aperture 154 may vary depending on the number of pumps 132, operating parameters, design parameters, etc.

In the illustrated embodiment, to aid in the transfer of motion from the cam 152, a cam follower 160 may be connected to an end of each piston 140 via a clevis 162, as best illustrated in FIG. 4. The cam follower 160 includes a roller 164 that is rotationally supported by the clevis 162 about a clevis pin 166. Once assembled, the roller 164 is positioned adjacent the inner cam surface 156 and is configured to rotate against the inner cam surface 156 about the clevis pin 166.

In some embodiments, a first end of each clevis pin 166 may extend through the elongated opening 138 of the lower guide plates 134. Additionally or alternatively, a second end of each clevis pin 166 may extend through the elongated opening 138 of the upper guide plates 136. As a result, the lower and upper guide plates 134 and 136 guide the movement of the rollers 164, and in turn, defines the path of travel of the reciprocating movement of the pistons 140. In that regard, the lower and upper guide plates may be configured to remove radial forces imparted on the pistons 140 by the cam 152. In operation, as the cam 152 rotates, the roller 164 rolls along the inner cam surface 156, and as the pistons 140 are reciprocatingly driven within the cylindrical bore 144 by the cam 152, each clevis pin 166 reciprocates along a longitudinal axis of its corresponding elongated opening 138.

As briefly described above, the gas booster 100 receives a fluid at a first pressure via the inlet 116 and discharges the fluid at a second, higher pressure via the outlet 118. In that regard, the chambers 146 of the pumps 132 are selectively connected in fluid communication with the inlet 116 and the outlet 118 of the gas booster 100 via the valve manifold 130 as shown in FIGS. 3-5. In particular, the inlet 116 is selectively connected in fluid communication with the chamber 146 via one or more first conduits 170 having first ports opening into the chamber 146. The outlet 118 is selectively connected in fluid communication with the chamber 146 via at least one second conduit 172 having a second port opening in to the chamber 146. To impart the selective fluid communication between the inlet 116 and the chamber 146 there is provided a first check valve 174 (FIG. 4) within the first conduits or proximate the one or more of the first ports. To impart the selective fluid communication between the outlet 118 and the chamber 146 there is provided a second check valve 176 (FIG. 4) within the second conduit 172 or proximate the second port. In some embodiments, a common inlet cavity connects the inlet 116 to the first conduits 170. In one embodiment, the common inlet cavity is located between the valve manifold 130 and the main shaft 114.

In operation, the first check valve 174 is configured to connect the inlet 116 in fluid communication with the chamber 146 of a piston 140 via the first conduit 170 of the valve manifold 130 when the pressure within the chamber 146 is less than the pressure in the inlet 116. In that regard, as the piston 140 moves away from the main shaft 114, the volume of the chamber 146 expands, thereby reducing the pressure therein causing the first check valve 174 to open. The first check valve 174 closes when the pressure in chamber 146 is greater than the pressure in the inlet 116. On the other hand, the second check valve 176 is configured to open when the pressure in the chamber 146 is greater than the pressure in the outlet 118 and to close when the pressure in the chamber 146 is less than the pressure in the outlet 118.

In accordance with an aspect of the present disclosure, the first and second check valves 174 and 176 are configured and arranged so as to reduce or minimize the dead volume of the piston's stroke. In one embodiment, the gas booster 100 is configured to minimize the dead volume of the pumps 132 by using one ball-type check valve or the like proximate the second port or within the valve manifold 130 and one disk-type check valve, reed-type check valve, or the like proximate the chamber 146. In the illustrated embodiment, the first check valve 174 is a disk-type check valve and the second check valve 176 is a ball-type check valve. As such, the piston is capable of reciprocating toward the main shaft to a position that is proximate the check valve 174. It is to be appreciated that the ball-type check valve can also be a disk-type check valve, reed-type check valve, flapper-type valve, or the like.

As is best illustrated by FIG. 5, the ball-type check valve 176 includes a ball 180 configured to rest against a seat 182. The check valve 176 may include a spring (not shown), such as a compression spring, configured to hold the ball 180 against the seat 182, if desired. In one embodiment, the spring is located proximate the second port to further minimize the size of the dead volume. The opening and closing of a ball-type check valve is well known and thus will not be recited herein in the interest of brevity.

Still referring to FIG. 5, the check valve 174 includes a planar member, such as a disk 184, having a first surface and a second, opposite surface. In the illustrated embodiment, the disk 184 includes a centralized aperture. The aperture is positioned to allow the second conduit 172 of the valve manifold 130 to be placed in fluid communication with the chamber 146 via the second port. The check valve 174 may include one or more springs, such as leaf springs 188, on the outer perimeter of the disk 184. The leaf springs 188 are configured to hold the disk 184 against the valve manifold 130, thereby placing the valve 176 in the closed position, and to align the disk 194 with the valve manifold 130. In one embodiment, the leaf springs 188 and disk 184 act like a reed-type check valve. When a force greater than the leaf springs 188 are applied to the second surface of the disk 184 by the inlet fluid via the inlet 116, the leaf springs 188 deflect, thereby opening the valve 176.

In the illustrated embodiment, the first conduits 170 surround the second conduit 172. In one embodiment, the orientation of the second conduit 172 extending through an aperture of the disk 184 of the check valve 174, along with the first conduits 170 surrounding the second conduit 172, further limits the size of the dead volume. That is, the volume defined by the end of the piston 140 when the piston is at the end of a compression stroke, the first surface of the disk 184 and the second conduit 172 from the ball 176 of the check valve 176 proximate the chamber 146 is reduced, thereby increasing the output pressure that may be generated by each piston stroke, the compression ratio of the pump, and/or the efficiency of the gas booster.

Figure 6A:
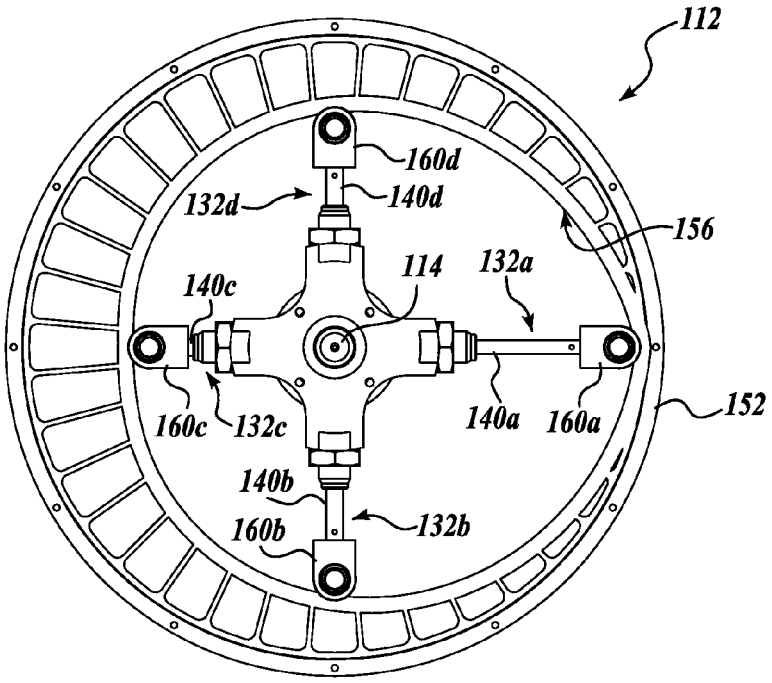
FIG. 6A is a top plan view of the pump assembly in a first position in accordance with aspects of the present disclosure.
Figure 6B:
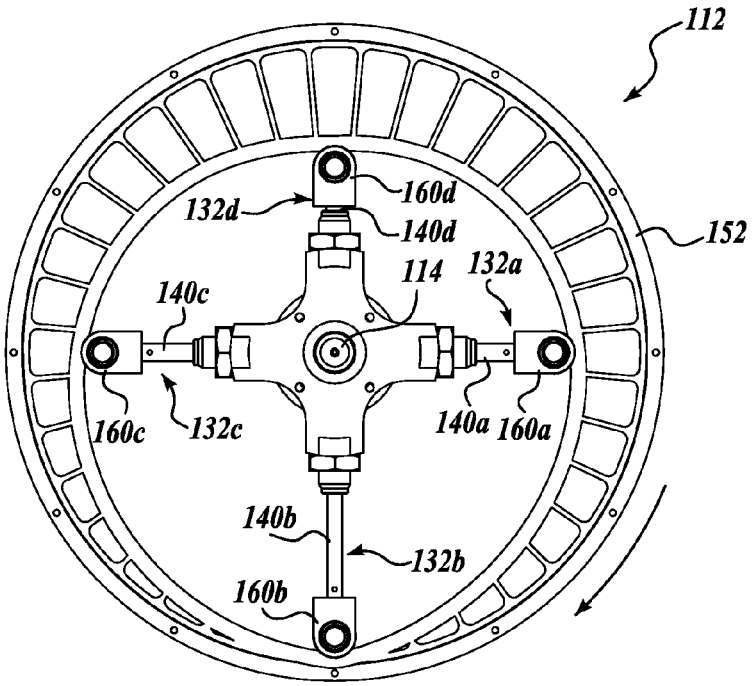
FIG. 6B is the pump assembly in FIG. 6A in a second position.

Turning now to FIGS. 6A and 6B, an example operation of the pump assembly 116 of FIGS. 3-5 will now be described. The pump assembly 112 of FIGS. 6A and 6B do not illustrate the lower and upper guide plates 134 and 136 for ease of explanation. In the illustrated embodiment, the cam 152 is rotated about the main shaft 114 in a clockwise direction by the motor 110 (FIG. 2). In the first position illustrated in FIG. 6A, the piston 140*a* is positioned at the end of its expansion stroke as the inner cam surface 156 is at its greatest radial distance from the main shaft 114. At the opposite side of the cam 152, the piston 140*c* is positioned at the end of its compression stroke as the inner cam surface 156 is at its smallest radial distance from the main shaft 114. The piston 140*b* is proximate the transition from the greatest radial distance to the smallest radial distance from the main shaft 114 and is in the process of expanding the volume in its chamber. The piston 140*d* is proximate the transition from the smallest radial distance to the greatest radial distance from the main shaft 114 and is in the process of compressing the volume of its chamber.

As the cam 152 rotates in the clockwise direction, the piston 140*c* begins to move away from the main shaft 114 due, for example, to the biasing force discussed above. In that regard, the volume in the corresponding chamber increases, thereby decreasing the pressure in the chamber. A differential pressure causes the disk 184 to move away from the valve manifold 130 opening the valve 174 and allowing the lower pressure gas in the supply bottle to fill the chamber.

As the cam 152 continues to rotate, the inner cam surface 156 causes the piston 140*a* to begin to move toward the main shaft 114 the radial distance of the inner cam surface 156 to the main shaft 114 begins to get smaller. In that regard, the volume in the corresponding chamber decreases, thereby increasing the pressure in the chamber. A differential pressure causes the second check valve 176 to open, allowing the high pressure gas in the chamber 146 to exit into the outlet 118.

The cam 152 rotates clockwise from the first position illustrated in FIG. 6A to the second position illustrated in FIG. 6B. In the second position, the piston 140*d* has moved to the end of its compression stroke, and the piston 140*b* has moved to the end of its expansion stroke. The piston 140*a* is in the process of compressing the volume in its chamber, and the piston 140*c* is in the process of expanding the volume in its chamber.

Figure 7:
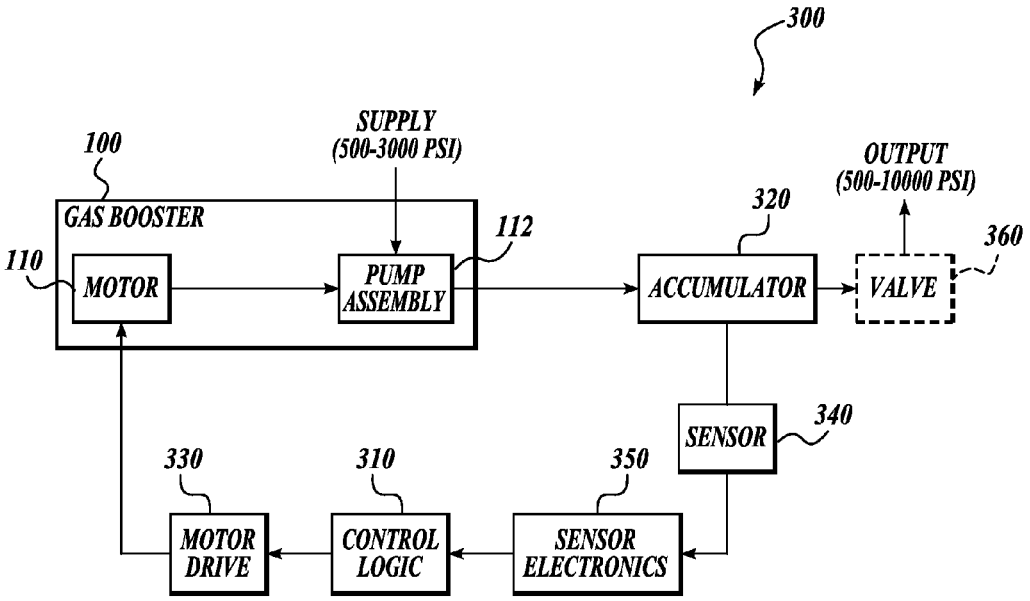
FIG. 7 is a block diagram of a system incorporating a gas booster in accordance with aspects of the present disclosure.

Turning now to FIG. 7, there is shown a block diagram of a system 300 that includes a control logic device 310, such as a controller, a microprocessor, digital circuitry, or the like, for controlling a gas booster 100 in order to obtain a particular pressure in a storage device, such as an accumulator 320. The control logic device 310 is connected in electrical communication with a motor drive circuit 330, which is, in turn, coupled in electrical communication with a motor 110 of the gas booster 100.

As described in reference to FIG. 2, the motor 110 is mechanically coupled with the pump assembly 112. In the system 300 of FIG. 7, the pump assembly 112 is in fluid communication with the accumulator 320, which is configured to receive the output fluid from the pump assembly 112. Proximate to and in fluid communication with the accumulator 320 is the pressure sensor 340 configured to measure the pressure of the fluid therein. The pressure sensor 340 includes or is coupled to pressure sensor electronics 350 and is configured to provide a pressure signal to the sensor electrics 350. The pressure sensor 340 and the sensor electronics 350 are configured to provide a feedback signal indicative of the pressure in the accumulator 320 to the control logic device 310.

The control logic device 310 includes an input/output interface in which a desired pressure for the accumulator 320 may be set. The control logic device 310 processes signals received from the input/output interface and outputs control signals to the motor drive circuit 330. In response to receiving the control signals, the motor drive circuit 330 processes the control signals and outputs suitable device level signals to the motor 110. Upon receipt of the device level signals, the motor 110 causes the rotary-to-reciprocating mechanism of the pump assembly 112 to rotate.

The control logic device 310 may include sufficient logic to compare the feedback signal to the desired pressure. Based on the comparison, the control logic device 310 may continue to drive the motor 110, such as when the feedback signal indicates that the pressure in the accumulator 320 is less than the desired pressure, or to cease driving the motor 110, such as when the feedback signal indicates that the pressure in the accumulator 320 is greater than the desired pressure. The system 300 may optionally include a valve 360 to output the gas stored therein to another device, such as a pressure controller.

It will be appreciated that various components can be "controlled" according to various logic for carrying out the intended function(s) of the gas booster. Examples of logic described herein may be implemented in a variety of configurations, including but not limited to hardware (e.g., analog circuitry, digital circuitry, processing units, etc., and combinations thereof), software, and combinations thereof. In circumstances where the components are distributed, the components are accessible to each other via communication links.

Various principles, representative embodiments, and modes of operation of the present disclosure have been described in the foregoing description. However, aspects of the present disclosure which are intended to be protected are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the claimed subject matter.

The embodiments of the disclosure in which an exclusive property or privilege is claimed are defined as follows:

1. A gas booster, comprising:

at least one cylinder having a bore therein;

a piston moveable in the bore of the at least one cylinder thereby forming a cavity that expands and contracts in response to the piston moving within the bore, wherein the cavity is configured to receive a gas at a first pressure level via a first port and to output the gas at a second pressure level via a second port;

a mechanism configured to cause the piston to move within the bore from a first position to a second position;

a first check valve having a planar sealing member located in the bore proximate the first port, the first check valve selectively permitting the gas to enter the cavity through the first port, wherein the piston is proximate the planar sealing member at the second position; and a second check valve located proximate the second port, the second check valve selectively permitting the gas to exit the cavity though the second port;

wherein the first and second check valves are configured and arranged so as to minimize the dead volume of the cavity when the piston has attained the second position.

2. The gas booster of claim 1, wherein the planar sealing member is positioned within the cavity and adjacent at least the first port, the planar sealing member being moveable into and out of contact with the first port for selectively permitting the gas from entering the cavity through the first port.

3. The gas booster of claim 2, wherein the planar sealing member includes an aperture that is disposed in fluid communication with the second port.

4. The gas booster of claim 3, wherein the first port includes a plurality of first ports positioned to surround the second port.

5. The gas booster of claim 1, wherein the mechanism is a cam.

6. The gas booster of claim 5, wherein the cam includes an aperture forming an inner cam surface that surrounds the at least one cylinder and the piston, and wherein rotation of the cam causes the inner cam surface to move the piston from the first position to the second position.

7. The gas booster of claim 6, wherein the inner cam surface is configured to cause the piston to reciprocate in the bore of the cylinder.

8. The gas booster of claim 1, further comprising a plurality of cylinders, each cylinder having a first port, a second port, and a cavity.

9. A gas booster, comprising:

two or more cylinders having a bore therein;

a piston moveable in each bore of the two or more cylinders, forming cavities with a variable volume that expands and contracts in response to the pistons moving within the bores;

an inlet configured to receive a gas at a first pressure level and an outlet configured to output a gas at a second pressure level, wherein the inlet is selectively connected in fluid communication with the cavity via a first check valve in the bore and the outlet is selectively connected in fluid communication with the cavity via a second check valve, wherein the first check valve is a disk-type check valve; and a cam including an aperture forming an inner cam surface that surrounds the two or more cylinders and the pistons, wherein rotation of the cam causes the inner cam surface to move the pistons from a first position to a second position, and wherein the piston is proximate the disk-type check valve at the second position.

10. The gas booster of claim 9, wherein the two or more cylinders are disposed in a radial arrangement.

11. The gas booster of claim 10, wherein the two or more cylinders are four cylinders.

12. The gas booster of claim 9, wherein the inner cam surface is configured to cause each piston to move in the bore of the cylinder.

13. The gas booster of claim 12, wherein the second check valve includes a movable ball.

14. The gas booster of claim 9, wherein the first and second check valves are arranged and configured to minimize the dead volume of the cavities.

15. The gas booster of claim 14, further comprising a mechanical advantage device operatively coupled to the cam for rotating the cam, wherein the mechanical advantage device is a planetary gear set comprising a sun gear, a plurality of planetary gears, and a ring gear, the cam being coupled to at least one of the planetary gears.

16. A system, comprising:

one or more cylinders having a bore therein;

a piston moveable in each bore of the one or more cylinders, forming a variable volume cavity that expands and contracts in response to the piston moving within the bore, wherein the variable volume cavity is configured to receive a gas at a first pressure level via a first port and to output the gas at a second, higher pressure level via a second port;

a cam including an aperture forming an inner cam surface that surrounds the one or more cylinders and the piston, wherein rotation of the cam causes the inner cam surface to move the piston from a first position to a second position;

a first check valve located in the bore proximate the first port and a second check valve located proximate the second port, the first check valve selectively permitting the gas to enter the cavity through the first port and the second check valve selectively permitting the gas to exit the cavity through the second port, wherein the first check valve is a disk-type check valve, and wherein the piston is proximate the disk-type check valve at the second position;

a prime mover configured to rotate the cam; and a control logic device configured to generate control signals and to provide the control signals to the prime mover, wherein the control signals are configured to cause the prime mover to rotate the cam.

17. The system of claim 16, further comprising an accumulator in fluid communication with the second port, wherein the accumulator is configured to receive and to store the gas at the second pressure level.

18. The system of claim 17, further comprising a pressure sensor in fluid communication with the accumulator, wherein the pressure sensor is configured to sense a third pressure level, and wherein the control logic device is configured to receive a feedback signal indicative of the third pressure level.

19. The system of claim 18, wherein the control logic device is configured to receive an input signal indicative of a desired pressure level of the gas stored in the accumulator, and wherein the control logic device is configured to compare the feedback signal to the input signal.

20. The system of claim 16, wherein the prime mover is an electric motor.

* * * * *